US009079743B2

(12) United States Patent
Ando et al.

(10) Patent No.: US 9,079,743 B2
(45) Date of Patent: Jul. 14, 2015

(54) SHEET DISCHARGE CONTROL BY SHEET CONVEYING APPARATUS

(71) Applicant: CANON KABUSHIKI KAISHA, Tokyo (JP)

(72) Inventors: Yutaka Ando, Toride (JP); Mitsuhiko Sato, Kashiwa (JP); Shunsuke Nishimura, Tokyo (JP); Takashi Yokoya, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 10 days.

(21) Appl. No.: 13/868,406

(22) Filed: Apr. 23, 2013

(65) Prior Publication Data

US 2013/0292897 A1 Nov. 7, 2013

(30) Foreign Application Priority Data

May 1, 2012 (JP) ..... 2012-104888

(51) Int. Cl.
*B65H 31/26* (2006.01)

(52) U.S. Cl.
CPC ..... *B65H 31/26* (2013.01); *B65H 2301/422* (2013.01); *B65H 2301/4213* (2013.01); *B65H 2301/541* (2013.01); *B65H 2511/30* (2013.01); *B65H 2511/40* (2013.01); *B65H 2511/415* (2013.01); *B65H 2513/51* (2013.01); *B65H 2801/06* (2013.01); *B65H 2801/27* (2013.01)

(58) Field of Classification Search
USPC ..... 270/58.01, 58.07, 58.11, 58.12, 58.17, 270/58.27
See application file for complete search history.

(56) References Cited

U.S. PATENT DOCUMENTS

| | | | | |
|---|---|---|---|---|
| 5,722,650 | A | 3/1998 | Yamamoto et al. | |
| 5,735,515 | A | 4/1998 | Hayashi et al. | |
| 5,769,406 | A | 6/1998 | Sato | |
| 5,778,300 | A | 7/1998 | Murakami et al. | |
| 6,085,913 | A | 7/2000 | Aiko et al. | |
| 6,374,077 | B1 | 4/2002 | Hirai et al. | |
| 6,412,774 | B1 * | 7/2002 | Saito et al. | 271/220 |
| 6,702,279 | B2 * | 3/2004 | Adachi et al. | 271/220 |
| 7,021,616 | B2 | 4/2006 | Mizuta et al. | |
| 7,413,177 | B2 * | 8/2008 | Mori et al. | 270/58.09 |
| 7,566,051 | B2 * | 7/2009 | Kodama et al. | 270/58.12 |
| 7,568,688 | B2 * | 8/2009 | Nomura et al. | 270/58.12 |
| 7,581,725 | B2 * | 9/2009 | Fujita et al. | 270/58.17 |
| 7,607,652 | B2 * | 10/2009 | Kushida | 270/58.12 |
| 7,766,324 | B2 * | 8/2010 | Tamura et al. | 271/213 |
| 7,938,388 | B2 | 5/2011 | Fujii et al. | |
| 8,393,372 | B2 | 3/2013 | Yamauchi et al. | |
| 8,413,978 | B2 | 4/2013 | Watanabe et al. | |
| 2008/0213017 | A1 * | 9/2008 | Morisawa et al. | 399/405 |
| 2010/0247203 | A1 | 9/2010 | Watanabe et al. | |

FOREIGN PATENT DOCUMENTS

| | | | |
|---|---|---|---|
| JP | 2005-206335 | A | 8/2005 |
| JP | 2006-206331 | A | 8/2006 |

* cited by examiner

*Primary Examiner* — Leslie A Nicholson, III
(74) *Attorney, Agent, or Firm* — Fitzpatrick, Cella, Harper & Scinto

(57) ABSTRACT

Discharging a sheet bundle of a sheet N and a sheet N-1 on preceding sheets already stacked on a stacking tray can cause the already-stacked sheets to be pushed out by the front end of the succeeding sheets. By pressing already-stacked sheets with a bundle pressing member when a sheet bundle of succeeding sheets is discharged, it is possible to reduce the likelihood of the already-stacked sheets being pushed out. Employing the bundle pressing member reduces disturbance of sheet alignment that can occur when a sheet bundle is discharged on already-stacked sheets.

18 Claims, 13 Drawing Sheets

FIG. 7

750

| |
|---|
| SHEET ID |
| PAPER WIDTH [mm] |
| PAPER LENGTH [mm] |
| BASIS WEIGHT [gsm] |
| TYPE OF SHEET MATERIAL |
| POST-PROCESSING MODE |
| DISCHARGE DESTINATION |
| JOB INFORMATION |
| COPY SET INFORMATION |
| ⋮ |
| BUFFER MODE |
| NUMBER OF SHEETS TO BE BUFFERED |

SHEET DISCHARGE CONTROL BY SHEET CONVEYING APPARATUS

BACKGROUND OF THE INVENTION

1. Field of the Invention

The present invention relates to sheet discharge control performed by a sheet conveying apparatus.

2. Description of the Related Art

Post-processing apparatuses are apparatuses for aligning, sorting, and stapling a plurality of sheets output from an image forming apparatus. Japanese Patent Laid-Open No. 2005-206335 discloses an alignment plate that moves in a direction orthogonal to the direction in which sheets are discharged, in order to align a plurality of sheets discharged on a tray. In particular, the alignment plate abuts on a sheet bundle for a longer time than normal when a sheet stacked on the tray is the final sheet, thus improving alignment of the sheet bundle. Japanese Patent Laid-Open No. 2006-206331 proposes an apparatus for improving productivity of post-processing performed on preceding sheets by superimposing several succeeding sheets on the preceding sheets.

Superimposing a plurality of sheets one above another and discharging them together, however, may create a situation in which preceding sheets already stacked on the tray are pushed out by a plurality of succeeding sheets due to the weight of the succeeding sheets. This may result in disturbance of sheet alignment.

SUMMARY OF THE INVENTION

The present invention reduces disturbance of sheet alignment that can happen when a sheet bundle of a plurality of succeeding sheets is discharged on preceding sheets.

An embodiment of the present invention provides a sheet conveying apparatus comprising the following elements. A discharge unit is configured to discharge a sheet. A stacking unit is configured to stack a sheet discharged from the discharge unit. A pressure unit is configured to press a preceding sheet stacked on the stacking unit against the stacking unit when a sheet bundle of a plurality of succeeding sheets is discharged on the preceding sheet.

Further features of the present invention will become apparent from the following description of exemplary embodiments with reference to the attached drawings.

BRIEF DESCRIPTION OF THE DRAWINGS

FIG. 7 is a diagram for describing sheet information.

DESCRIPTION OF THE EMBODIMENTS

Overall Configuration

Figure 1:
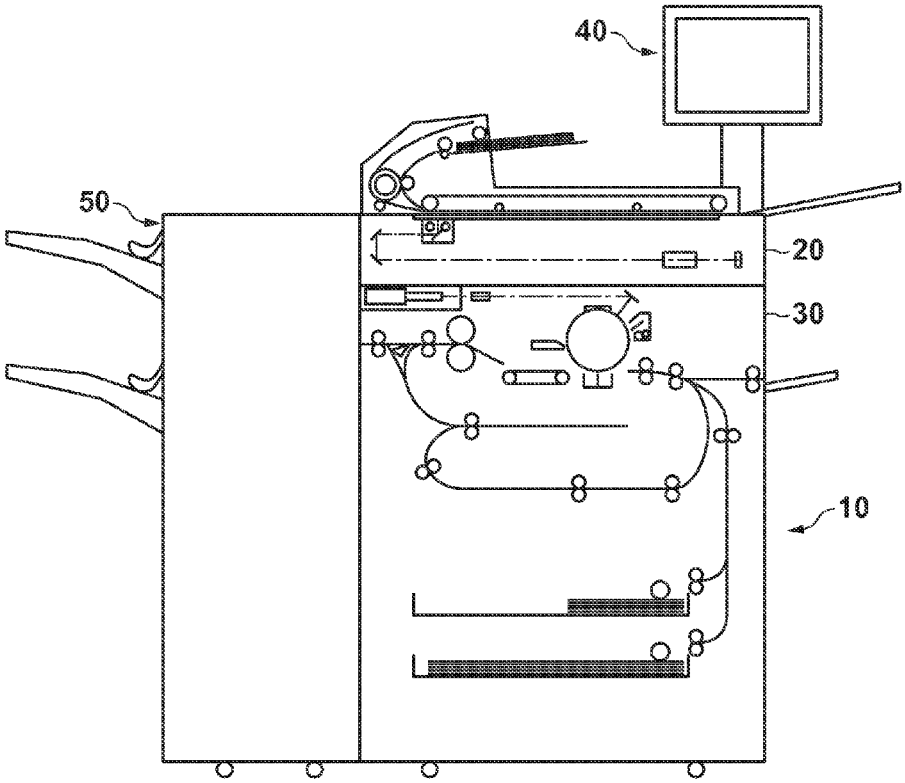
FIG. 1 is a diagram illustrating a longitudinal cross-sectional structure of a principle part of an image forming system.

Now, a principle part of an image forming system will be described with reference to FIG. 1. An image forming apparatus 10 forms, for example, an image read from a document with an image reader 20 on a sheet (printing material) using a printer 30 and outputs the sheet to a finisher 50. The finisher 50 functions as a sheet conveying apparatus. A UI unit 40 includes, for example, a plurality of keys for setting various types of functions regarding image forming, and a display unit for displaying information indicating the setting state. The finisher 50 is a kind of sheet conveying apparatus for conveying sheets and executes post-processing on sheets. Examples of the post-processing include punching, stapling, bookbinding, and sorting.

Block Diagram of Overall System

Figure 2:
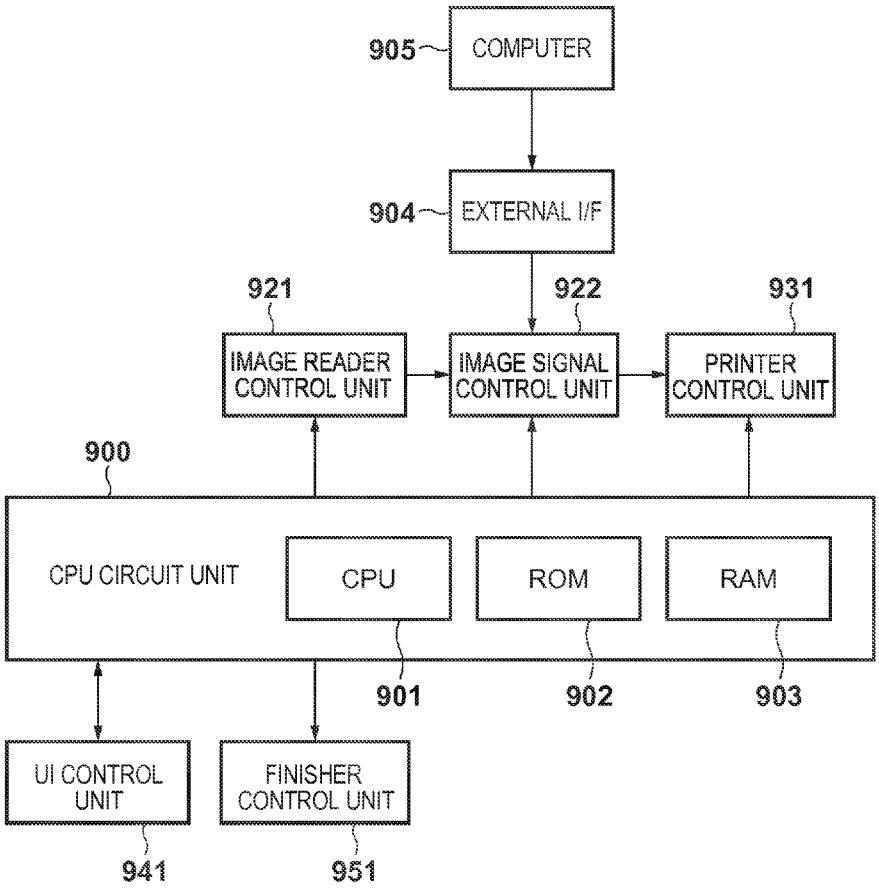
FIG. 2 is a block diagram of a controller that controls the image forming system.

As illustrated in FIG. 2, a CPU circuit unit 900 contains a CPU 901, a ROM 902, and a RAM 903. The CPU 901 performs basic control of the overall image forming system. The CPU 901 is connected to the ROM 902 in which a control program is written and the RAM 903 serving as a work area via an address bus and a data bus. By executing the control program stored in the ROM 902, the CPU 901 performs overall control of an image reader control unit 921, an image signal control unit 922, an external I/F 904, a printer control unit 931, a UI control unit 941, and a finisher control unit 951. The RAM 903 temporarily stores control data and is also used as a work area for computational processing associated with the control.

The image reader control unit 921 controls the image reader 20 and transfers an image signal output by the image reader 20 to the image signal control unit 922. The image signal control unit 922 converts an analog image signal received from the image reader 20 into a digital signal, converts this digital signal into a video signal, and outputs the video signal to the printer control unit 931. The image signal control unit 922 also performs various types of processing on a digital image signal that is input from a computer 905 via the external I/F 904, converts this digital image signal into a video signal, and outputs the video signal to the printer control unit 931. These processing activities performed by the image signal control unit 922 are controlled by the CPU circuit unit 900. The printer control unit 931 controls the printer 30 based on an input video signal and forms an image on recording paper. The finisher control unit 951 is mounted on the finisher 50 and exchanges information with the CPU circuit unit 900 to perform overall drive control of the finisher 50. The UI control unit 941 allows information to be exchanged between the UI unit 40 and the CPU circuit unit 900. The term "UI" as used herein is an abbreviation for User Interface. The UI control unit 941 outputs a key signal corresponding to each key operation performed on the UI unit 40 to the CPU circuit unit 900 and displays corresponding information on the UI unit 40, based on a signal from the CPU circuit unit 900.

UI unit

Figure 3A:
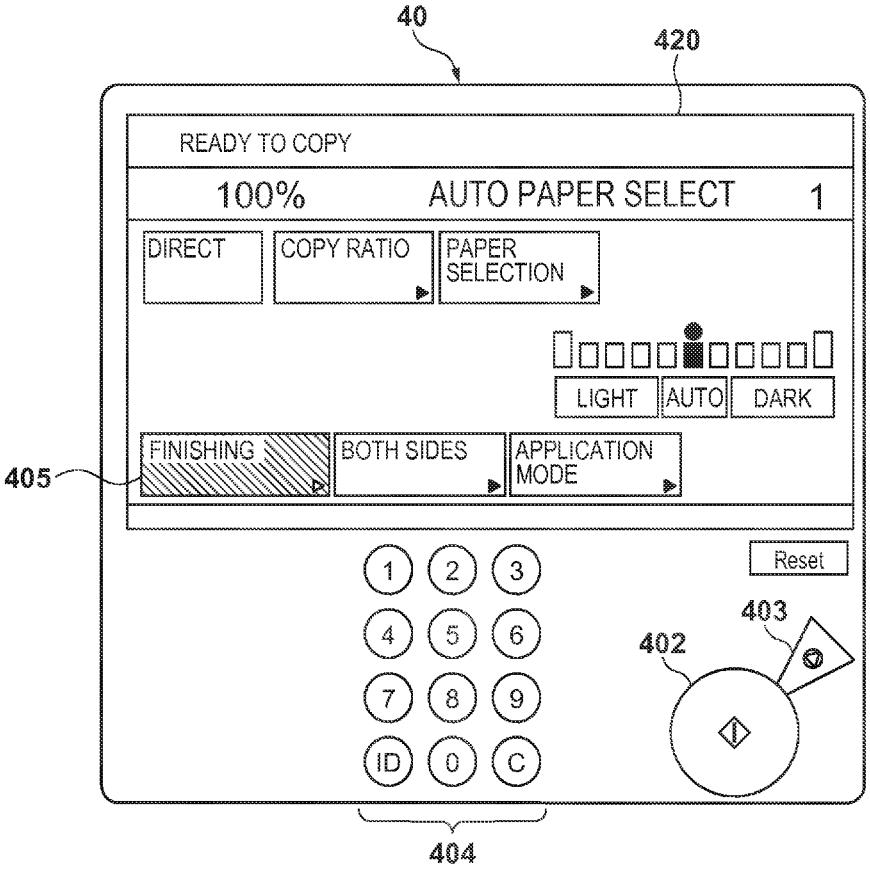
FIGS. 3A, 3B, and 3C are diagrams for describing a UI unit.

FIG. 3A illustrates the UI unit 40 of the image forming apparatus in FIG. 1. A start key 402 is a key for instructing the start of an image forming operation. A stop key 403 is a key for instructing an interruption of an image forming operation. A numeric keypad 404 includes keys for inputting numerical values for, for example, setting the number of copies. These keys are hardware keys. A display unit 420 is a combined input and display device provided with a touch panel and displays software keys. A finishing key 405 is a key for selecting the type of finishing.

Figure 3B:
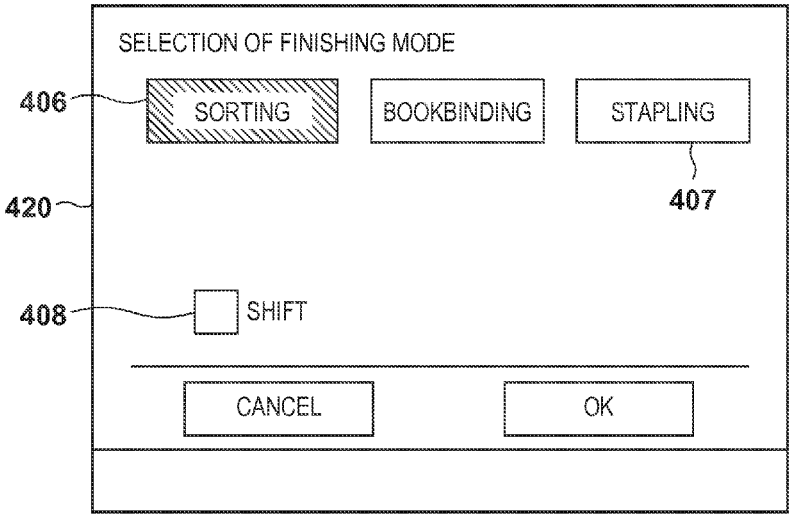
Figure 3C:
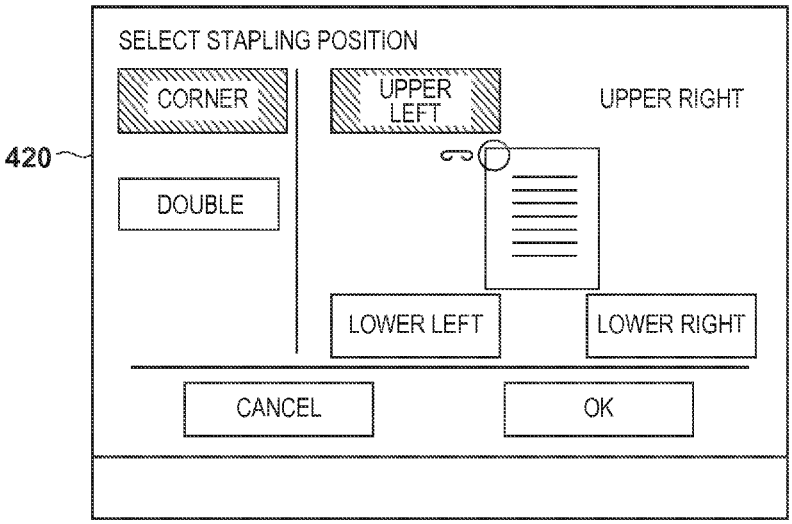

Upon detecting that the finishing key 405 has been operated, the CPU 901 causes the UI control unit 941 to display a setting screen as illustrated in FIG. 3B on the display unit 420. Examples of finishing modes include non-sorting, sorting, bookbinding, and staple sorting (binding mode). When a soft key 406 for designating "Sorting" is selected by the operator, the CPU 901 stores information indicating that the sorting mode has been set, in the RAM 903. When a soft key 407 for designating "Stapling" is pressed by the operator, the CPU 901 causes the display unit 420 to display a stapling setting screen as illustrated in FIG. 3C. In this screen, the operator is capable of selecting a binding method such as corner binding or double (two-point) binding. When a soft key 408 for designating "Shift" is selected by the operator in FIG. 3B, the CPU 901 stores information indicating that the shift mode has been set, in the RAM 903. In this shift mode, for example, multiple copies of sheet bundles are produced by shifting the positions of odd-numbered copies and by not shifting the positions of even-numbered copies. This enables the operator to easily find out the ends of the respective copies. Selecting none of the sorting, bookbinding, and stapling modes indicates that the non-sorting mode is selected. The CPU 901 creates a start notification indicating the content of a job set by the operator and transmits the start notification to the finisher control unit 951.

Finisher

Figure 4:
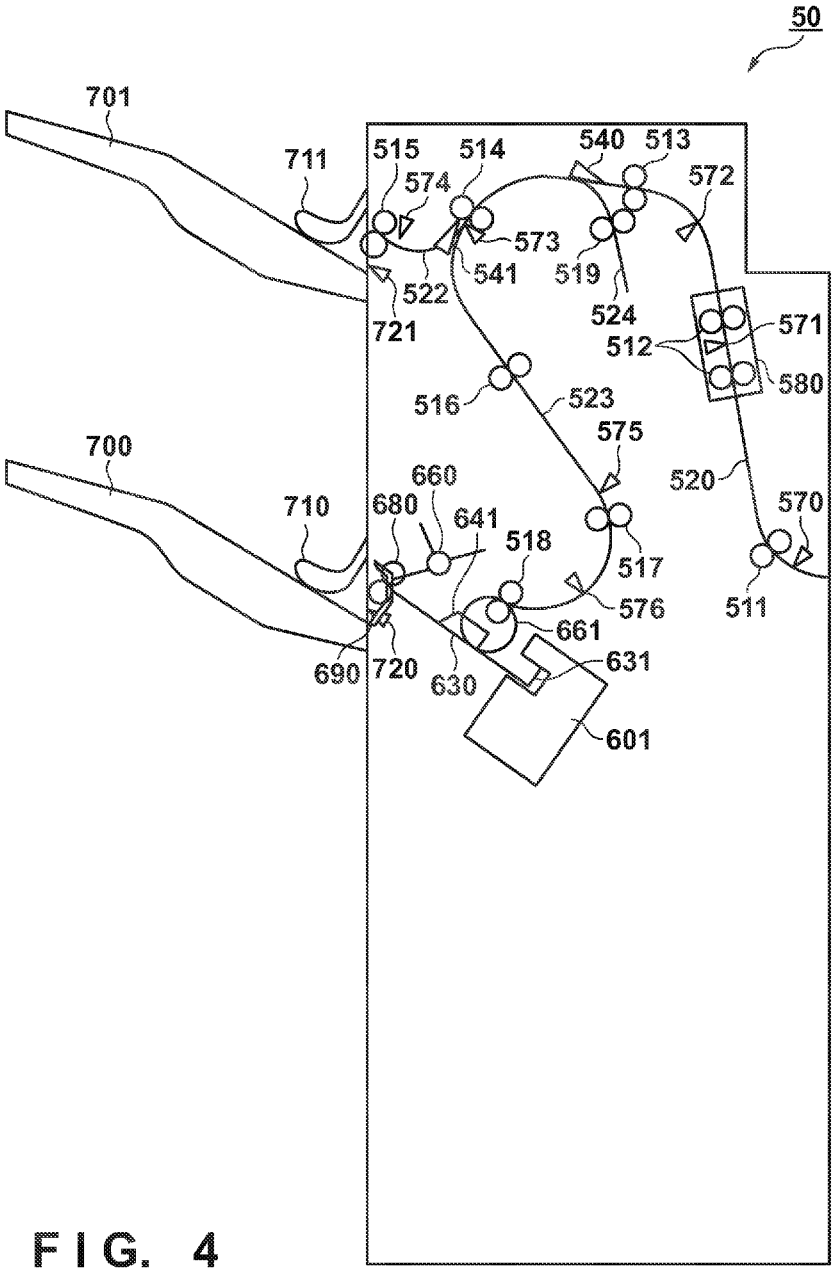
FIG. 4 is a cross-sectional view of a finisher.

Now, the finisher 50 will be described with reference to FIGS. 4 and 5. The finisher 50 sequentially takes in a plurality of sheets discharged from the image forming apparatus 10 and performs post-processing such as processing for aligning the sheets taken in to form a single sheet bundle and stapling processing for stapling the trailing edge of a sheet bundle.

The finisher 50 takes sheets discharged from the image forming apparatus 10 into a conveyance path 520 with a conveying roller pair 511. The sheets taken in by the conveying roller pair 511 are conveyed further downstream by conveying roller pairs 512 and 513. Passage of such sheets is detected by each of conveyance sensors 570, 571, and 572 provided on the conveyance path 520.

The conveying roller pairs 512 are provided in a shift unit 580 together with the conveyance sensor 571. The shift unit 580 is movable along the width of a sheet (sheet width direction) that is orthogonal to the conveying direction by a shift motor M4 illustrated in FIG. 5. By driving the shift motor M4 while a sheet is being caught by the conveying roller pairs 512, the sheet may be offset in the sheet width direction during conveyance. In the shift mode selected by the operator using the shift key 408, the shift unit 580 offsets each front-shifting sheet in front by 15 mm and each back-shifting sheet to the back by 15 mm. When the shift key 408 is not pressed, the shift unit 580 passes each sheet without offsetting it. Upon detecting the passage of a sheet through the shift unit 580 by signal input from the sheet conveyance sensor 571, the finisher control unit 951 drives the shift motor M4 to return the shift unit 580 to a center position.

A flapper 540 is disposed between the conveying roller pair 513 and a conveying roller pair 514. The flapper 540 guides a sheet that is reversely conveyed by the conveying roller pair 514 to a buffer path 524 that serves as a buffer unit. The buffer path 524 is provided with a conveying roller pair 519 for feeding a sheet, which is held in staying, again to the main conveyance path. The conveying roller pair 514, the flapper 540, and the buffer path 524 are disposed on the conveyance path for conveying sheets and configured to hold at least one sheet in staying and feed that sheet again to the conveyance path, thereby serving as a staying unit that forms a sheet bundle by superimposing a sheet held in staying and a succeeding sheet.

Another flapper 541 is disposed between the conveying roller pair 514 and a conveying roller pair 515. The flapper 541 switches to which path, namely an upper discharge path 522 or a lower discharge path 523, a sheet is conveyed. When the flapper 541 switches to the upper discharge path 522, a sheet is guided to the upper discharge path 522 by the conveying roller pair 514, which is driven by a buffer motor M2 illustrated in FIG. 5. This sheet is then discharged to a stacking tray 701 by the conveying roller pair 515, which is driven by a discharge motor M3. The passage of such a sheet is detected by conveyance sensors 573 and 574 provided on the upper discharge path 522. A sheet-surface detection sensor 721 detects whether or not a sheet is stacked on the stacking tray 701.

When the flapper 541 switches to the lower discharge path 523, a sheet is guided to the lower discharge path 523 by the conveying roller pair 514. This sheet is then guided to a processing tray 630 by conveying roller pairs 516, 517, and 518, which are driven by the discharge motor M3. The passage of such a sheet is detected by conveyance sensors 575 and 576 provided on the lower discharge path 523.

The sheet guided to the lower discharge path 523 is discharged to a stacking tray 700, either passing through or bypassing the processing tray 630 depending on the mode selected by the operator. When the operator has selected "Stapling," the sheet is discharged first to the processing tray 630 and then from the processing tray 630 to the stacking tray 700. When "Stapling" is not selected, the sheet is discharged to the stacking tray 700 by a bundle discharge roller pair 680 without being stacked on the processing tray 630, the bundle discharge roller pair 680 being driven by a bundle discharge motor M5 illustrated in FIG. 5. At this time, the finisher control unit 951 may cause a bundle pressing member 690, which is driven by a bundle pressing motor M6, to press the sheet stacked on the stacking tray 700. The bundle discharge roller pair 680 thus functions as a discharge unit configured to discharge sheets. The stacking tray 700 is inclined downward toward the bundle discharge roller 680 and functions as a stacking unit configured to stack sheets discharged from the bundle discharge roller pair 680. The bundle pressing member 690 functions as a pressure unit configured to press preceding sheets stacked on the stacking unit against the stacking unit when a sheet bundle of a plurality of succeeding sheets is discharged on the preceding sheets. In place of the bundle pressing motor M6, another driving mechanism such as a solenoid may be employed.

Figure 5:
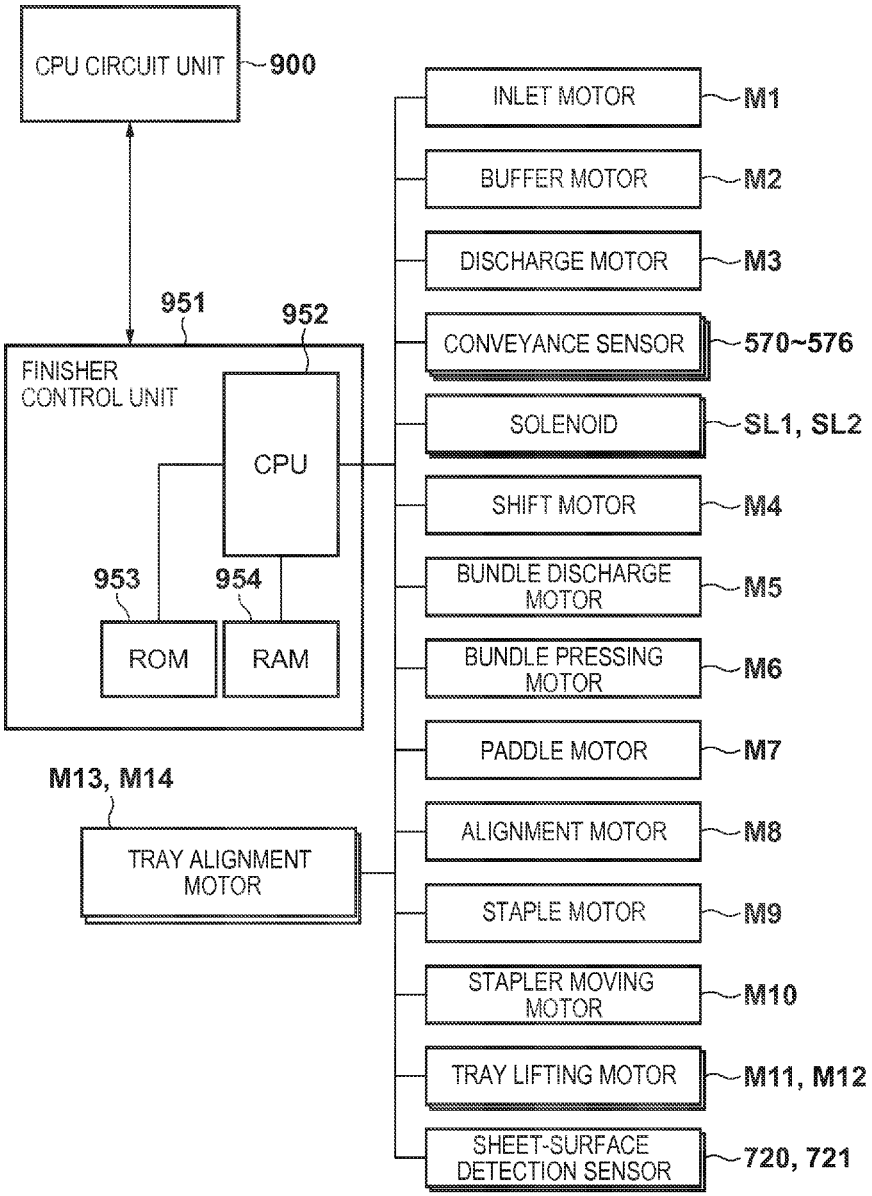
FIG. 5 is a block diagram of a finisher control unit.

A sheet discharged to the processing tray 630 is drawn back to the opposite side of the sheet discharge direction by a knurling belt 661 and a paddle 660, the knurling belt 661 being driven in synchronization with the conveying roller pair 518, and the paddle 660 being driven by a paddle motor M7 illustrated in FIG. 5. The sheet that has been drawn back bumps into a stopper 631 and stops. Alignment members 641 that are disposed on the front and back sides of the processing tray 630 are moved in a direction orthogonal to a sheet conveyance direction by an alignment motor M8. This aligns sheets stacked on the processing tray 630. A stapler 601 staples a sheet bundle. Then, preceding sheets stacked on the stacking tray 700 are pressed by the bundle pressing member 690, which is driven by the bundle pressing motor M6, and a sheet bundle of succeeding sheets is discharged onto the stacking tray 700 by the bundle discharge roller pair 680. A sheet-surface detection sensor 720 detects whether or not a sheet is stacked on the stacking tray 700.

On the stacking tray 700, an alignment plate 710 is disposed to align sheets in the width direction orthogonal to the sheet discharge direction. The alignment plate 710 is constituted by a pair of alignment plates that are movable in the width direction. Note that an alignment plate 711 having a similar configuration is also disposed on the stacking tray 701.

Block Diagram of Finisher

Now, a configuration of the finisher control unit 951 that controls the driving of the finisher 50 will be described with reference to FIG. 5. The finisher control unit 951 is constituted by, for example, a CPU 952, a ROM 953, and a RAM 954 as illustrated in FIG. 5. The CPU 952 communicates with the CPU circuit unit 900, which is provided on the image forming apparatus 10 side, to exchange data and executes various types of programs stored in the ROM 953 in accordance with instructions from the CPU circuit unit 900, thus controlling the driving of the finisher 50. The CPU 952 stores data and flags necessary for such control in the RAM 954.

An inlet motor M1 drives the conveying roller pairs 511, 512, and 513. The buffer motor M2 drives the conveying roller pairs 514 and 519. The discharge motor M3 drives the conveying roller pairs 515, 516, 517, and 518. The shift motor M4 drives the shift unit 580.

The processing tray 630 will now be described. The bundle discharge motor M5 drives the bundle discharge roller pair 680. The bundle pressing motor M6 drives the bundle pressing member 690. The paddle motor M7 drives the paddle 660. The alignment motor M8 drives the alignment members 641. A stapling motor M9 drives the stapler 601 that binds a sheet bundle. A stapler moving motor M10 moves the stapler 601 in the direction orthogonal to the conveying direction along the outer periphery of the processing tray 630. This changes the staple binding position. The CPU 952 receives detection signals from the conveyance sensors 570 to 576 to detect the passage of a sheet.

Tray lifting motors M11 and M12 lift the stacking trays 700 and 701 up and down. Tray alignment motors M13 and M14 move the alignment plates 710 and 711. The CPU 952 is further provided with the sheet-surface detection sensors 720 and 721 to detect whether or not sheets are stacked on the stacking trays 700 and 701. A solenoid SL1 drives the flapper 540, and a solenoid SL2 drives the flapper 541.

Buffering Operation

The term "buffering operation" as used herein refers to processing for causing a sheet discharged from the image forming apparatus 10 to be temporarily held in staying on the conveyance path (buffer path 224), superimposing that sheet on a succeeding sheet, and then conveying these sheets. While post-processing (such as the operation of aligning sheets on a stacking tray) is being performed on a sheet bundle of preceding sheets, succeeding sheets cannot be conveyed to the trays. Even in the case where a sheet is not discharged to the processing tray 630, time is still needed to, for example, move the alignment plate 710 when the alignment position in the width direction is to be changed for alignment of sheets discharged to the stacking tray 700 in the width direction using the alignment plate 710. For these reasons, buffering succeeding sheets is necessary. Also, discharging thin paper having a small basis weight increases the amount of time from when a sheet is discharged from the bundle discharge roller pair 680 to when the sheet falls on the stacking tray 700, as compared with the case of discharging plain paper. Thus, when the alignment plate 710 performs alignment of thin paper with the same timing as the case of plain paper, appropriate alignment may not be performed because the alignment may be performed before the stacking of sheets is completed. Such an increase in the amount of the falling time of sheets can be prevented by superimposing two pieces of thin paper and discharging them together. Thus, buffering is also performed when thin paper is discharged.

Processing for Setting Buffer Mode

Figure 6:
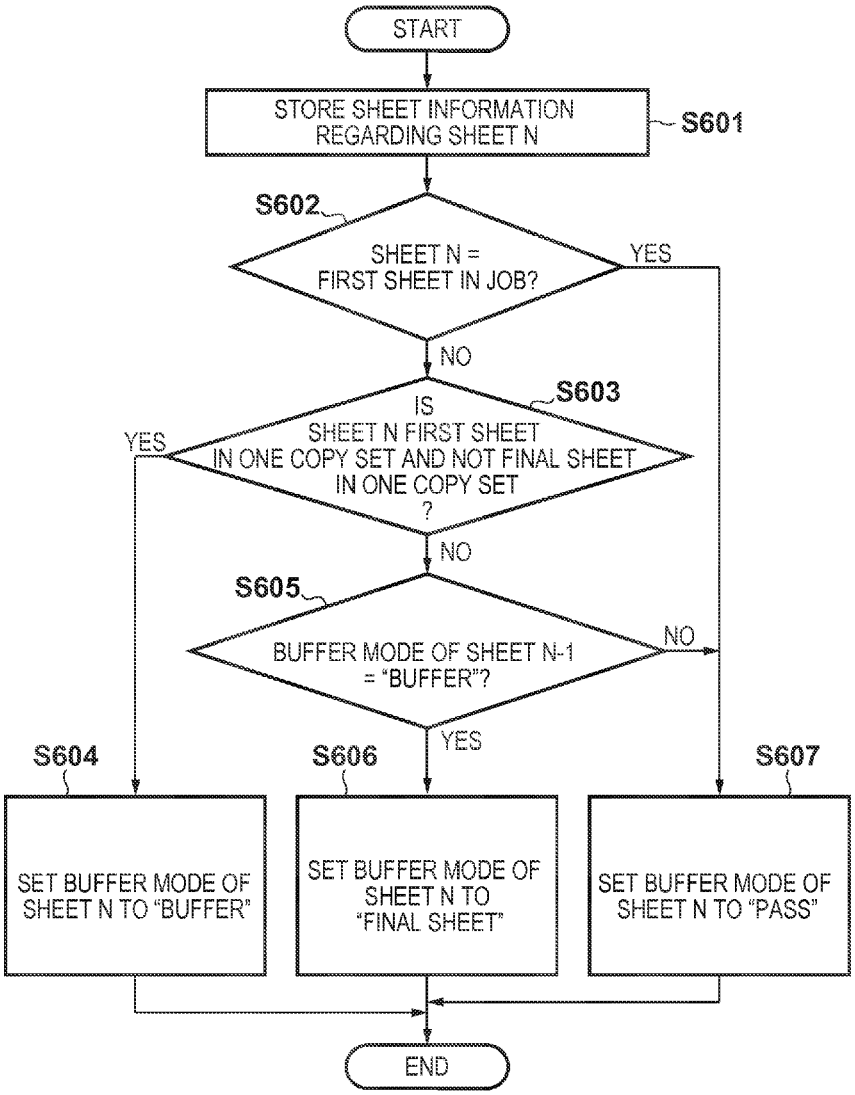
FIG. 6 is a flowchart of processing for setting a buffer mode.

Processing for setting the buffer mode of a sheet, performed by the CPU 952 of the finisher 50, will now be described with reference to the flowchart in FIG. 6. The CPU 952 of the finisher control unit 951 starts the processing for setting a buffer mode upon receiving a notification indicating the start of sheet transfer (sheet transfer start notification) given from the CPU 901 of the CPU circuit unit 900.

FIG. 7 shows sheet information 750 stored in the RAM 954. Part of the sheet information 750 is included in the sheet transfer start notification. The sheet transfer start notification includes information for specifying, for example, a sheet ID for identifying the sheet, a paper length that is the length of the sheet in the conveying direction, a paper width, a basis weight, and the type of sheet material (e.g., paper or a resin). The sheet transfer start notification may further include information for specifying the post-processing mode such as non-sorting, sorting, stapling, or bookbinding, information indicating the destination of discharge such as the upper stacking tray or the lower stacking tray, information indicating what number in a job the current sheet is, and information indicating the number of copies of the same sheet to be printed. The sheet information 750 may further include buffer-mode information indicating whether to pass the sheet through or to subject the sheet to buffering, and buffer count information indicating the number of sheets to be buffered in a buffer. The CPU 952 sets the buffer mode of a sheet by referencing the sheet information 750. The following processing is executed by the CPU 952, unless otherwise specified.

In step S601, the CPU 952 substitutes the information included in a sheet transfer start notification regarding a sheet N received from the CPU 901 into the sheet information 750 and stores the sheet information 750 in the RAM 954. The sheet N is a sheet to be processed at that point in time.

In step S602, the CPU 952 references job information in the sheet information 750 to determine whether or not the sheet N is the first sheet in a job. When the sheet N is the first sheet in the job, the procedure proceeds to step S607.

In step S607, the CPU 952 sets the buffer mode of the sheet N to "Pass" and stores information regarding the buffer mode into the sheet information stored in the RAM 954, and then this setting processing ends. The buffer mode of "Pass" means that the sheet N is to be conveyed without being retained on the buffer path 224 or being superimposed on a sheet retained on the buffer path. When the sheet N is not the first sheet in the job, on the other hand, the procedure proceeds to step S603.

In step S603, the CPU 952 references copy set information in the sheet information 750 to determine whether or not the sheet N is the first sheet in a "one copy set" and whether or not the sheet N is the final sheet in the one copy set. When the sheet N is the first sheet in the one copy set and is not the final sheet in the one copy set, the procedure proceeds to step S604. For a one copy set constituted by three sheets, for example, the first sheet is determined as being the first sheet in the one copy set and is not the final sheet in the one copy set.

In step S604, the CPU 952 sets the buffer mode of the sheet N to "Buffer" and stores the sheet information 750 in the RAM 954, and then this setting processing ends. The buffer mode of "Buffer" means that the sheet N is to be retained on the buffer path 224. Specific conveyance processing performed on a sheet having a buffer mode of "Buffer" will be described later. When the sheet N is not the first sheet in the one copy set, the procedure proceeds to step S605. Similarly, when the sheet N is the final sheet in the one copy set, the procedure proceeds to step S605. For a one copy set constituted by a single sheet, for example, the first sheet is the first sheet in the one copy set and is also the final sheet in the one copy set. In this case, the procedure proceeds to step S605. For a one copy set constituted by three sheets, for example, the second sheet is determined as being neither the first sheet in the one copy set nor the final sheet in the one copy set and accordingly the procedure proceeds to step S605. The third sheet in this case is not the first sheet in the one copy set and thus the procedure proceeds to step S605.

In step S605, the CPU 952 determines whether or not the buffer mode of a sheet N-1, which is the sheet previous to the sheet N, is "Buffer". When the buffer mode of the sheet N-1 is "Buffer", the procedure proceeds to step S606.

In step S606, the CPU 952 creates sheet information 750 indicating that the buffer mode of the sheet N has been set to "Final Sheet" and stores the sheet information 750 in the RAM 954, and then this setting processing ends. The buffer mode of "Final Sheet" means that the sheet N is to be superimposed on a sheet retained on the buffer path 224.

When the buffer mode of the sheet N-1 is other than "Buffer," on the other hand, the procedure proceeds to step S607. The buffer mode other than "Buffer" is, for example, "Final Sheet" or "Pass".

In step S607, the CPU 952 sets the buffer mode of the sheet N to "Pass" and stores the sheet information 750 in the RAM 954, and then this setting processing ends.

Finisher Operation in Each Buffer Mode

The operation of the finisher 50 in each buffer mode will now be described with reference to FIGS. 8A to 8D. The movement of the finisher 50 when a sheet P1 having a buffer mode of "Buffer" is conveyed will be described with reference to FIG. 8A. The CPU 952 controls the buffer motor M2 to stop conveyance after a predetermined period of time has elapsed since the conveyance sensor 573 has detected the leading edge of a sheet P1 discharged from the image forming apparatus 10. The sheet P1 will thus stop when its leading edge has advanced a predetermined distance from the conveyance sensor 573. This predetermined period of time is, in design, determined depending on the distance from the conveyance sensor 573 at which the leading edge of the sheet P1 is to stop.

Figure 8A:
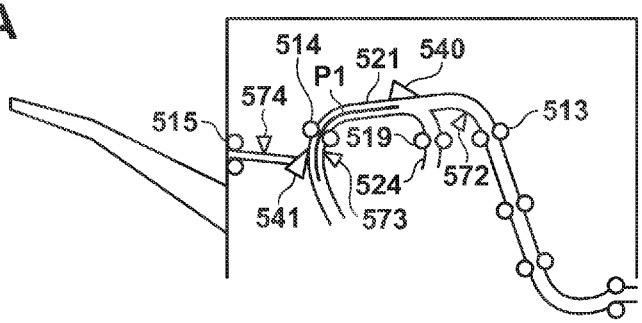
FIGS. 8A, 8B, 8C, and 8D are diagrams for describing buffering.
Figure 8B:
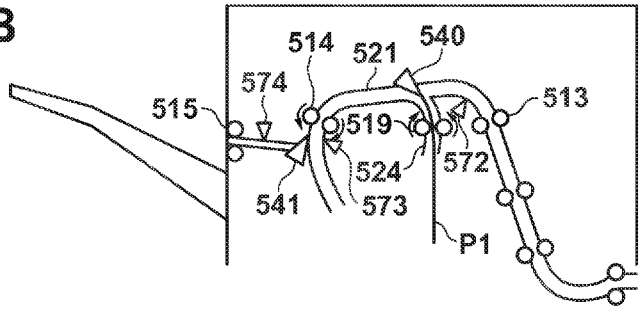

Then, as illustrated in FIG. 8B, the CPU 952 drives the solenoid SL1 to switch the flapper 540 such that the sheet P1 is guided to the buffer path 524. The CPU 952 further reversely drives the buffer motor M2 to reversely drive the conveying roller pairs 514 and 519, and accordingly the sheet P1 is guided to the buffer path 524. After a predetermined period of time has elapsed since the leading edge of the sheet P1 has passed through the conveyance sensor 573, the CPU 952 stops the buffer motor M2, thus holding the sheet P1 in staying on the buffer path 524. This predetermined period of time is required to house the leading edge of the sheet P1 into the buffer path 524 and is determined by experiment or simulation.

Figure 8C:
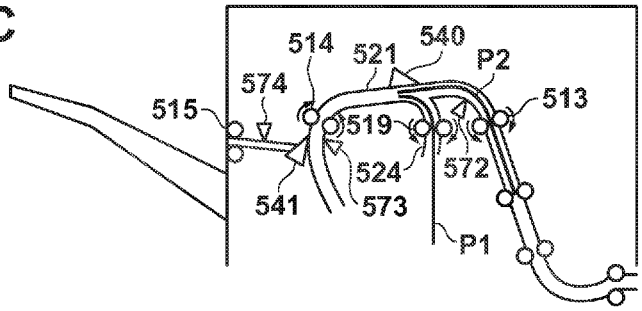

Next, the movement of the finisher 50 when a sheet P2 having a buffer mode of "Final Sheet" is conveyed will be described. The CPU 952 drives the solenoid SL1 to switch the flapper 540 such that the sheet P2 is guided to the discharge path 521. After a predetermined period of time has elapsed since the conveyance sensor 572 has detected the leading edge of the sheet P2 discharged from the image forming apparatus 10, the CPU 952 drives the buffer motor M2 to rotate the conveying roller pairs 514 and 519, thereby starting the conveyance of the sheet P1 that is held in staying on the buffer path 524. The sheet P1 is thus superimposed on the sheet P2 on the conveyance path as illustrated in FIG. 8C. The CPU 952 subsequently drives the discharge motor M3 to convey a resultant sheet bundle of these two sheets to the downstream of the conveyance path.

This superimposition eliminates the need for the image forming apparatus 10 to delay the conveyance of a succeeding sheet even while post-processing is being performed on a sheet bundle on the processing tray 630. Of course, the image forming apparatus 10 does not need to suspend image forming.

Figure 8D:
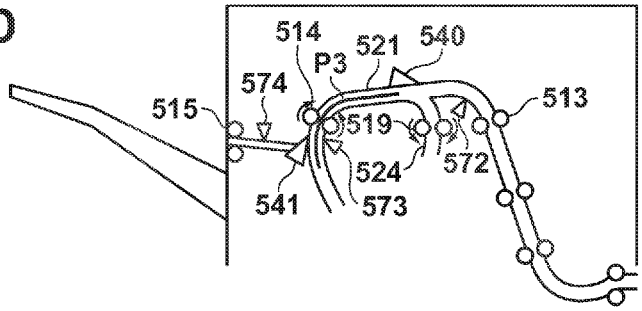

Lastly, the movement of the finisher 50 when a sheet P3 having a buffer mode of "Pass" is conveyed will be described with reference to FIG. 8D. The CPU 952 drives the inlet motor M1 and the buffer motor M2 to convey the sheet P3 discharged from the image forming apparatus 10. The CPU 952 subsequently drives the discharge motor M3 to convey the sheet P3 further downstream.

Switching Control of Driving of Bundle Pressing Member

Providing a pressure unit is a feature of the present invention. The pressure unit is configured to press preceding sheets stacked on the stacking tray 700 against the stacking tray 700 when a sheet bundle of a plurality of succeeding sheets is discharged on the preceding sheets. The reason why the provision of the pressure unit is advantageous will now be described with reference to FIGS. 9A and 9B.

Figure 9A:
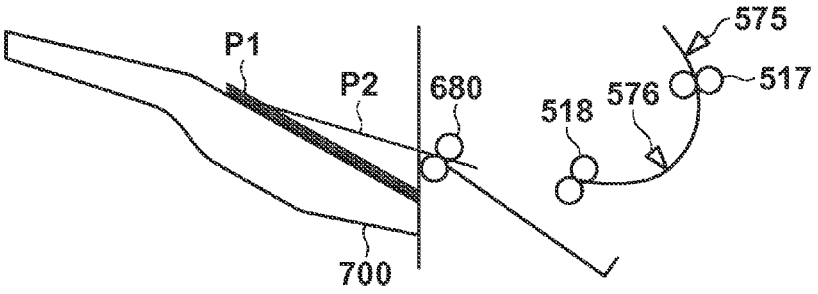
FIGS. 9A and 9B are diagrams showing how sheets stacked on a stacking tray are pushed out.

FIG. 9A shows discharge of a single succeeding sheet P2 when preceding sheets P1 are stacked on the stacking tray 700. In this case, the pressure applied to the preceding sheets P1 is small because only the single succeeding sheet P2 is discharged on the preceding sheets P1 and the weight of the succeeding sheet P2 is relatively light. The preceding sheets P1 are thus not pushed out in the discharge direction.

Figure 9B:
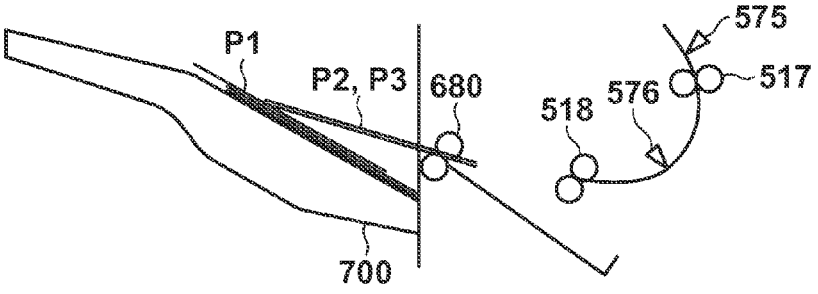

If a sheet bundle of succeeding sheets P2 and P3 is discharged on the preceding sheets P1 as illustrated in FIG. 9B, the weight of the succeeding sheets as a sheet bundle increases and accordingly the pushing force of the sheet bundle increases. The preceding sheets P1 are thus pushed out in the discharge direction by the sheet bundle. In other words, the alignment of sheets on the stacking tray 700 is disturbed. In view of this, in the present embodiment, the preceding sheets P1 stacked on the stacking tray 700 are pressed and held against the stacking tray 700 when the sheet bundle of the succeeding sheets P2 and P3 is discharged on the preceding sheets P1.

Figure 10:
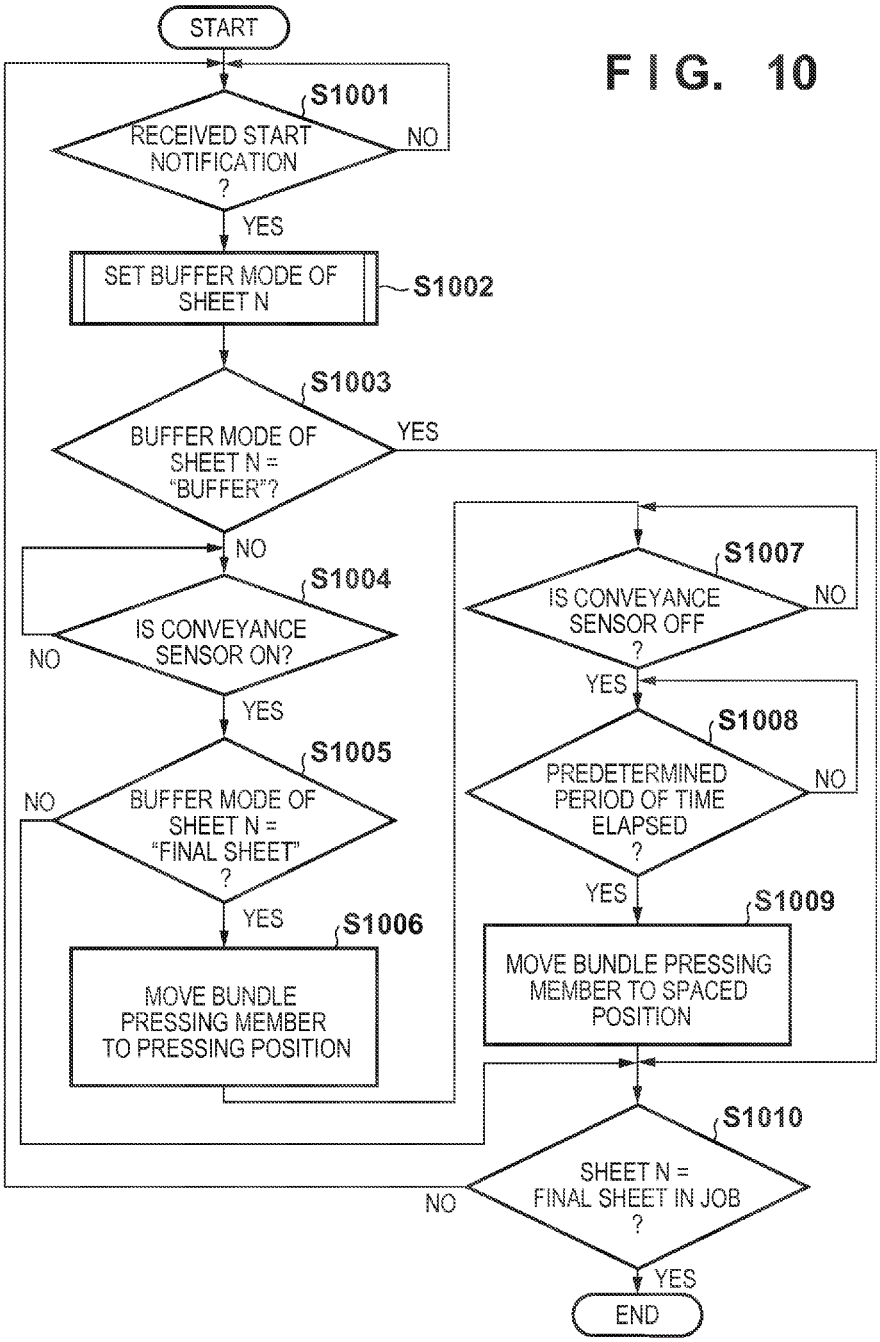
FIG. 10 is a flowchart of a bundle pressing operation.

Now, an operation of driving the bundle pressing member 690 to control the switching of whether or not to press sheets on the stacking tray 700 will be described with reference to FIGS. 10 and 11.

In step S1001, the CPU 952 determines whether or not a sheet transfer start notification has been received from the CPU 901 of the circuit unit 900. Upon receipt of a start notification, the procedure proceeds to step S1002.

In step S1002, the CPU 952 sets the buffer mode of a sheet N. This setting processing corresponds to steps S601 to S607 in FIG. 6.

In step S1003, the CPU 952 references the sheet information 750 stored in the RAM 954 to specify the buffer mode of the sheet N, and determines whether or not the buffer mode is "Buffer". When the buffer mode is "Buffer," the CPU 952 performs control for holding the sheet N in waiting and staying on the buffer path 524 as illustrated in FIG. 8B. A specific content of the control is as described with reference to FIG. 8B. Note that the CPU 952 does not drive the bundle pressing member 690 because the sheet N is not immediately discharged to the stacking tray 700. The procedure then proceeds to step S1010 for processing of the next sheet. When the buffer mode of the sheet N is not "Buffer", the procedure proceeds to step S1004.

In step S1004, the CPU 952 waits until the conveyance sensor 575 is turned on. The conveyance sensor 575 is in the ON state while a sheet is passing through the conveyance sensor 575. When the conveyance sensor 575 is turned on, the procedure proceeds to step S1005.

In step S1005, the CPU 952 determines whether or the buffer mode of the sheet N is "Final Sheet". When the buffer mode is "Final Sheet", the procedure proceeds to step S1006. At this time, the CPU 952 performs control for superimposing a succeeding sheet on a preceding sheet and conveying them as illustrated in FIG. 8C. Specific content of the control is as described with reference to FIG. 8C. When the buffer mode of the sheet N is not "Final Sheet", i.e., when the buffer mode is "Pass", the CPU 952 performs control for discharging the sheet N independently as illustrated in FIG. 8D. Specific content of the control is as described with reference to FIG. 8D. As illustrated in FIG. 9A, such a single succeeding sheet is less likely to push out the sheets already stacked on the stacking tray 700. The CPU 952 thus does not drive the bundle pressing member 690, and the procedure proceeds to step S1010. The bundle pressing member 690 is not driven when a single succeeding sheet is discharged because of the following reasons. The interval from when a preceding sheet is discharged to when a succeeding sheet is discharged is set to be as short as possible from the viewpoint of productivity. This interval is extremely short and is shorter than the amount of time required for the bundle pressing member 690 to move and return. In other words, the movement and return of the bundle pressing member 690 cannot be completed within the interval from the discharge timing of a preceding sheet to the discharge timing of a succeeding sheet. If this interval is increased to such an extent that the movement and return of the bundle pressing member 690 can be completed within this interval, productivity will drop. The CPU 952 thus performs control such that the bundle pressing member 690 is not driven when a single succeeding sheet is discharged, thereby suppressing a drop in productivity.

Figure 11A:
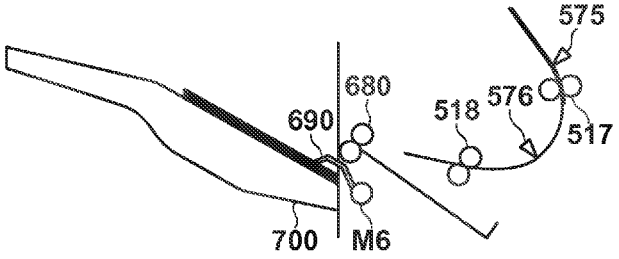
FIGS. 11A, 11B, 11C, and 11D are diagrams for describing a bundle pressing member.

In step S1006, the CPU 952 drives the bundle pressing motor M6 to move the bundle pressing member 690 to a pressing position because the sheet N is superimposed on a sheet N-1 and discharged together. The movement of the bundle pressing member 690 may be started at such a time that allows the movement of the bundle pressing member 690 to be completed during an interval from when the leading edge of the sheet N (sheet N-1) is detected by the conveyance sensor 575 to when that sheet reaches the bundle discharge roller pair 680. As illustrated in FIG. 11A, the bundle pressing member 690 moves to its pressing position and presses the sheets stacked on the stacking tray 700.

In step S1007, the CPU 952 determines whether or not the conveyance sensor 575 is turned off (whether or not a sheet has passed through the conveyance sensor 575). When the conveyance sensor 575 is turned off, the procedure proceeds to step S1008.

Figure 11B:
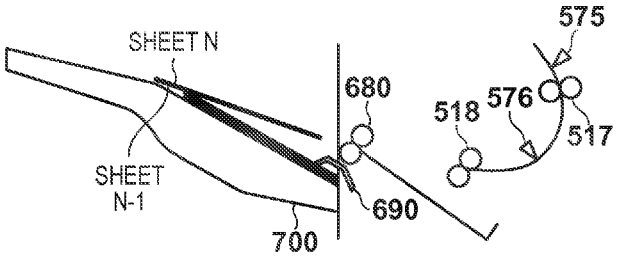

In step S1008, the CPU 952 determines whether or not a predetermined period of time has elapsed since the conveyance sensor 575 is turned off. As illustrated in FIG. 11B, a sheet bundle of the sheet N-1 and the sheet N after the elapse of a predetermined period of time has advanced up to a more forward position after its leading edge came in contact with the sheets already stacked on the stacking tray 700 during discharge. The sheet bundle during discharge pushes out the sheets stacked on the stacking tray 700 because the sheet bundle during discharge is advancing in the discharge direction in contact with the sheets stacked on the stacking tray 700. In other words, the sheet bundle does not push out the sheets stacked on the stacking tray 700 when it starts to return in the direction opposite to the discharge direction by the force of gravity. The CPU 952 can thus retract the bundle pressing member 690 if this time has come. The predetermined period of time thus indicates a time following the time when a sheet bundle starts to return in the direction opposite to the discharge direction by the force of gravity after the conveyance sensor 575 is turned off. By the bundle pressing member 690 pressing the sheets already stacked on the stacking tray 700 for a predetermined period of time, it is possible to suppress a phenomenon in which the sheet N and the sheet N-1 that are superimposed one above the other and conveyed together push out the already-stacked sheets. Note that the alignment of the already-stacked sheets may be disturbed in the width direction when the sheet bundle starts to return. The CPU 952 thus drives the alignment member (alignment plate 710) provided in the stacking tray 700 to align these sheets in the width direction.

Figure 11C:
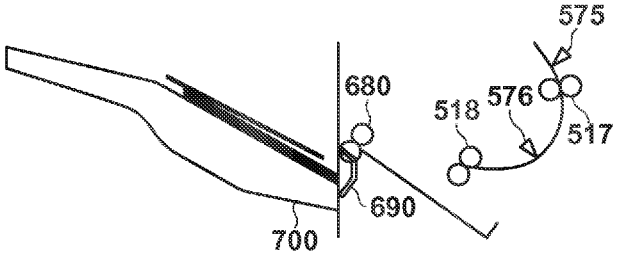
Figure 11D:
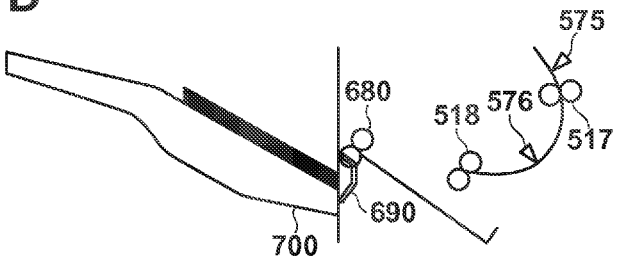

In step S1009, the CPU 952 drives the bundle pressing motor M6 to move the bundle pressing member 690 to a spaced position. As illustrated in FIG. 11C, the movement of the bundle pressing member 690 to a spaced position releases the sheets already stacked on the stacking tray 700 from the bundle pressing member 690. The bundle pressing member 690 starts to move to its spaced position illustrated in FIG. 11C after a predetermined period of time has elapsed since the conveyance sensor 575 is turned off. The trailing edge of the sheet N thus does not come in contact with the sheets already stacked on the stacking tray 700. This prevents the bundle pressing member 690 from disturbing the stacking of the sheet N. After the bundle pressing member 690 has retracted to its spaced position, the sheet bundle of the sheet N-1 and the sheet N is completely stacked on the already-stacked sheets as illustrated in FIG. 11D. In this way, after a sheet bundle of a predetermined number of succeeding sheets or more has started to return in the direction opposite to the discharge direction, the bundle pressing member 690 retracts to a position at which it does not press preceding sheets such that the trailing edges of the sheet bundle is not in contact with the bundle pressing member 690.

In step S1010, the CPU 952 determines whether or not the sheet N is the final sheet in the job, based on the job information included in the sheet information 750. When the sheet N is the final sheet in the job, the CPU 952 ends the processing shown in this flowchart. When the sheet N is not the final sheet in the job, the procedure returns to step S1001, in which the CPU 952 waits for a sheet transfer start notification for the next sheet.

As described above, by the bundle pressing member 690 pressing already-stacked preceding sheets when a plurality of superimposed succeeding sheets is discharged on the stacking tray 700, it is possible to suppress a phenomenon in which the succeeding sheets push out the already-stacked preceding sheets. This reduces disturbance in the alignment of sheets on the stacking tray 700. Although the present embodiment describes a case in which sheets bypass the processing tray 630, the bundle pressing member 690 may be operated in a similar manner even when sheets pass through the processing tray 630.

The description of the present embodiment is based on the assumption that a single sheet, which is held in staying on the buffer path 524, is superimposed on a succeeding sheet to form a sheet bundle and the sheet bundle of these two sheets is discharged. The number of sheets in a sheet bundle, however, may be two or more. A more generalized technical idea of the above description will be described with reference to FIG. 12.

Figure 12:
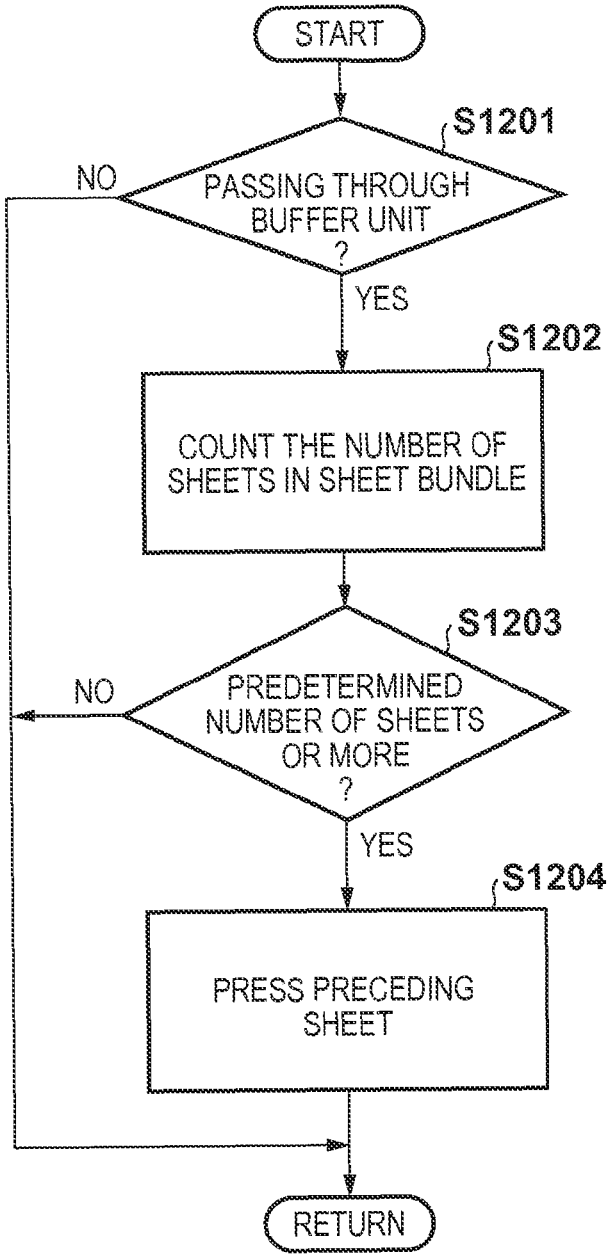
FIG. 12 is a flowchart of the bundle pressing operation.

As illustrated in FIG. 12, in step S1201, the CPU 952 analyzes the start notification or the sheet information 750 to determine whether or not sheets in a one copy set to be processed passes through the buffer unit. When a succeeding sheet is conveyed without being held in staying in the buffer unit, the CPU 952 skips steps S1202 to S1204. That is, the CPU 952 does not press preceding sheets against a stacking tray. When the sheets in the one copy set to be processed passes through the buffer unit, the procedure proceeds to step S1202.

In step S1202, the CPU 952 counts the number of sheets to be held in staying on the buffer path 524 by referencing the job information, increments the counter value by one, and calculates (counts) the number of sheets that forms a sheet bundle.

In step S1203, the CPU 952 determines whether or not a sheet bundle of at least a predetermined number of succeeding sheets is discharged on preceding sheets stacked on the stacking tray 700. This determination is made by comparing the number of sheets that constitute a sheet bundle with a predetermined number of sheets (threshold value). When a sheet bundle of at least a predetermined number of succeeding sheets is discharged on the preceding sheets stacked on the stacking tray 700, the procedure proceeds to step S1204.

In step S1204, the CPU 952 performs control such that the bundle pressing member 690 presses the preceding sheets. When a sheet bundle of less than the predetermined number of succeeding sheets is discharged, the CPU 952 skips step S1204 and performs control such that the bundle pressing member 690 does not press the preceding sheets.

Note that the CPU 952 may adjust the predetermined number of sheets according to paper type (plain paper, thick paper, or basis weight). This is because the pushing force varies depending on the material, thickness, and basis weight of paper. The relationship between paper type and a predetermined number of sheets may be obtained in advance by experiment or simulation and stored in the ROM 953 in the form of a table. This allows the CPU 952 to determine a predetermined number of sheets from information regarding paper type by simply referencing such a table.

In the present embodiment, at least one sheet is held in staying on the buffer path 524, which is provided on the conveyance path through which sheets are conveyed, and this staying sheet is superimposed on a succeeding sheet and fed again to the conveyance path, thus forming a sheet bundle of the staying sheet and the succeeding sheet. If such a sheet bundle is constituted by a predetermined number of sheets or more, the CPU 952 drives the bundle pressing member 690 such that the bundle pressing member 690 presses preceding sheets against the stacking tray 700. When a succeeding sheet bypasses the buffer path 524, the CPU 952 controls the bundle pressing member 690 such that the bundle pressing member 690 does not press preceding sheets against the stacking tray 700.

According to the present embodiment, the bundle pressing member 690 retracts to a position where it does not press preceding sheets as illustrated in FIG. 11C before a sheet bundle consisting of a predetermined number of succeeding sheets or more falls into the stacking tray 700 and comes in contact with the bundle pressing member 690 that is pressing already-stacked sheets, at its trailing edge. This prevents the bundle pressing member 690 from obstructing alignment of a sheet bundle fell on the stacking tray 700 in the discharge direction.

The bundle pressing member 690 is also disposed below the bundle discharge roller pair 680 in the vertical direction as illustrated in FIG. 11A. The bundle pressing member 690 includes a pressure member that presses sheets and a rotation shaft on which the pressure member is turned. The bundle pressing motor M6 functions as a drive unit for turning the pressure member. The present invention is thus also advantageous in terms of the manufacturing cost because the pressure unit can be achieved with a relatively simple configuration.

Although the above description mainly focuses on a case of discharging sheets without passing through the processing tray 630, the present invention is also applicable to a case in which stapling processing is performed on a sheet bundle on the processing tray 630 and the stapled sheet bundle is discharged. Specifically, the alignment of sheets may be disturbed if a stapled sheet bundle is discharged on an unstapled sheet bundle that has already been stacked on the stacking tray 700. The CPU 952, which has detected such a situation, thus may move the bundle pressing member 690 by controlling the bundle pressing motor M6.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-104888, filed May 1, 2012 which is hereby incorporated by reference herein in its entirety.

What is claimed is:

1. A sheet conveying apparatus comprising:

a staying unit disposed in a conveyance path through which a sheet is conveyed, and configured to hold at least one sheet in staying and feed the sheet held in staying again to the conveyance path to superimpose the sheet on a succeeding sheet, forming a sheet bundle of the sheet held in staying and the succeeding sheet;

a discharge unit configured to discharge a sheet or a sheet bundle;

a stacking unit configured to stack the sheet or the sheet bundle discharged from the discharge unit; and a pressure unit configured to press a preceding sheet or sheet bundle stacked on the stacking unit against the stacking unit when a succeeding sheet bundle of a plurality of sheets is discharged on the preceding sheet or sheet bundle on the stacking unit, wherein, in a case where a succeeding sheet bundle of a predetermined number of sheets or more is conveyed from the staying unit and the succeeding sheet bundle is to be stacked on the preceding sheet or sheet bundle on the stacking unit, the pressure unit presses the preceding sheet or sheet bundle against the stacking unit, and wherein, in a case where a succeeding sheet or sheet bundle of less than the predetermined number of sheets is conveyed from the staying unit and the succeeding sheet or sheet bundle is to be stacked on the preceding sheet or sheet bundle on the stacking unit, the pressure unit does not press the preceding sheet or sheet bundle against the stacking unit.

2. The sheet conveying apparatus according to claim 1, wherein the stacking unit includes a stacking tray that is inclined downward toward the discharge unit, and wherein, when the succeeding sheet bundle of the predetermined number of sheets or more starts to move in a direction opposite to a direction of discharge due to inclination of the stacking tray, the pressure unit retracts to a position where the pressure unit does not press the preceding sheet or sheet bundle.

3. The sheet conveying apparatus according to claim 1, wherein the pressure unit is disposed below the discharge unit in a vertical direction and includes a pressure member, and a drive unit that moves the pressure member such that a state of the pressure member is switched to a pressure state, in which the pressure member presses the preceding sheet or sheet bundle, or a non-pressure state, in which the pressure member does not press the preceding sheet or sheet bundle.

4. The sheet conveying apparatus according to claim 1, further comprising:

an obtaining unit configured to obtain information regarding a type of a sheet, wherein the predetermined number of sheets is determined according to the information obtained by the obtaining unit.

5. The sheet conveying apparatus according to claim 1, further comprising:

an alignment unit configured to align a sheet bundle stacked on the stacking unit in a width direction perpendicular to a sheet discharging direction.

6. A sheet conveying apparatus comprising:

a staying unit disposed in a conveyance path through which a sheet is conveyed, and configured to hold at least one sheet in staying and configured to feed the sheet held in staying again to the conveyance path to superimpose the sheet on a succeeding sheet, forming a sheet bundle of the sheet held in staying and the succeeding sheet, a discharge unit configured to discharge a sheet;

a stacking unit configured to stack the sheet discharged from the discharge unit; and a pressure unit configured to press a preceding sheet stacked on the stacking unit against the stacking unit when a sheet bundle of a plurality of succeeding sheets is discharged on the preceding sheet;

wherein, when the staying unit forms a sheet bundle of a predetermined number of succeeding sheets or more, the pressure unit presses the preceding sheet against the stacking unit, and wherein, when a succeeding sheet following the preceding sheet is conveyed without being held in staying by the staying unit, the pressure unit does not press the preceding sheet against the stacking unit.

7. The sheet conveying apparatus according to claim 6, further comprising:

an alignment unit configured to align a sheet bundle stacked on the stacking unit in a width direction perpendicular to a sheet discharging direction.

8. The sheet conveying apparatus according to claim 6, wherein the stacking unit includes a stacking tray that is inclined downward toward the discharge unit, and wherein, when the sheet bundle of the predetermined number of succeeding sheets or more starts to move in a direction opposite to a direction of discharge due to the inclination of the stacking tray, the pressure unit retracts to a position where the pressure unit does not press the preceding sheet, to prevent a trailing edge of the sheet bundle from being in contact with the pressure unit.

9. The sheet conveying apparatus according to claim 6, wherein the pressure unit is disposed below the discharge unit in a vertical direction, the pressure unit comprising:

a pressure member, and a drive unit which moves the pressure member such that a state of the pressure member is switched to a pressure state where the pressure member presses the preceding sheet, or a non-pressure state where the pressure member does not press the preceding sheet.

10. An image forming system comprising:

a sheet conveying apparatus; and an image forming apparatus configured to form an image on a sheet and output the sheet to the sheet conveying apparatus, the sheet conveying apparatus including:

a staying unit disposed in a conveyance path through which a sheet is conveyed, and configured to hold at least one sheet in staying and configured to feed the sheet held in staying again to the conveyance path to superimpose the sheet on a succeeding sheet, forming a sheet bundle of the sheet held in staying and the succeeding sheet, a discharge unit configured to discharge a sheet;

a stacking unit configured to stack the sheet discharged from the discharge unit; and a pressure unit configured to press a preceding sheet stacked on the stacking unit against the stacking unit when a sheet bundle of a plurality of succeeding sheets is discharged on the preceding sheet, wherein, when the staying unit forms a sheet bundle of a predetermined number of succeeding sheets or more, the pressure unit presses the preceding sheet against the stacking unit, and wherein, when a succeeding sheet following the preceding sheet is conveyed without being held in staying by the staying unit, the pressure unit does not press the preceding sheet against the stacking unit.

11. The image forming system according to claim 10, further comprising:

an alignment unit configured to align a sheet bundle stacked on the stacking unit in a width direction perpendicular to a sheet discharging direction.

12. The image forming system according to claim 10, wherein the stacking unit includes a stacking tray that is inclined downward toward the discharge unit, and wherein, when the sheet bundle of the predetermined number of succeeding sheets or more starts to move in a direction opposite to a direction of discharge due to the inclination of the stacking tray, the pressure unit retracts to a position where the pressure unit does not press the preceding sheet, to prevent a trailing edge of the sheet bundle from being in contact with the pressure unit.

13. The image forming system according to claim 10, wherein the pressure unit is disposed below the discharge unit in a vertical direction, the pressure unit comprising:

a pressure member, and a drive unit which moves the pressure member such that a state of the pressure member is switched to a pressure state where the pressure member presses the preceding sheet, or a non-pressure state where the pressure member does not press the preceding sheet.

14. An image forming system comprising:

a sheet conveying apparatus; and an image forming apparatus configured to form an image on a sheet and output the sheet to the sheet conveying apparatus, the sheet conveying apparatus including:

a staying unit disposed in a conveyance path through which a sheet is conveyed, and configured to hold at least one sheet in staying and feed the sheet held in staying again to the conveyance path so as to superimpose the sheet on a succeeding sheet, thus forming a sheet bundle of the sheet held in staying and the succeeding sheet, a discharge unit configured to discharge a sheet or sheet bundle;

a stacking unit configured to stack the sheet or the sheet bundle discharged from the discharge unit; and a pressure unit configured to press a preceding sheet or sheet bundle stacked on the stacking unit against the stacking unit when a succeeding sheet bundle of a plurality of sheets is discharged on the preceding sheet or sheet bundle on the stacking unit, wherein, in a case where a succeeding sheet bundle of a predetermined number of sheets or more is conveyed from the staying unit and the succeeding sheet bundle is to be stacked on the preceding sheet or sheet bundle on the stacking unit, the pressure unit presses the preceding sheet or sheet bundle against the stacking unit, and wherein, in a case where a succeeding sheet or sheet bundle of less than the predetermined number of sheets is conveyed from the staying unit and the succeeding sheet or sheet bundle is stacked on the preceding sheet or sheet bundle on the stacking unit, the pressure unit does not press the preceding sheet or sheet bundle against the stacking unit.

15. The image forming system according to claim 14, wherein the stacking unit includes a stacking tray that is inclined downward toward the discharge unit, and wherein, when the succeeding sheet bundle of the predetermined number of sheets or more starts to move in a direction opposite to a direction of discharge due to the inclination of the stacking tray, the pressure unit retracts to a position where the pressure unit does not press the preceding sheet or sheet bundle, to prevent a trailing edge of the succeeding sheet bundle from being in contact with the pressure unit.

16. The image forming system according to claim 14, wherein the pressure unit is disposed below the discharge unit in a vertical direction and includes a pressure member, and a drive unit that moves the pressure member such that a state of the pressure member is switched to a pressure state where the pressure member presses the preceding sheet or sheet bundle or a non-pressure state where the pressure member does not press the preceding sheet or sheet bundle.

17. The image forming system according to claim 14, further comprising:

an obtaining unit configured to obtain information regarding a type of a sheet, wherein the predetermined number of sheets is determined according to the information obtained by the obtaining unit.

18. The image forming system according to claim 14, further comprising:

an alignment unit configured to align a sheet bundle stacked on the stacking unit in a width direction perpendicular to a sheet discharging direction.

* * * * *